US005418106A

United States Patent [19]

Snyder, Jr. et al.

[11] Patent Number: 5,418,106

[45] Date of Patent: May 23, 1995

[54] REJUVENATED ORGANIC PHOTORECEPTOR AND METHOD

[75] Inventors: Donald E. Snyder, Jr., Brockport; William A. Donofrio, Hilton, both of N.Y.; William J. Murphy, San Jose, Calif.

[73] Assignee: Nu-Kote International, Inc., Dallas, Tex.

[21] Appl. No.: 85,988

[22] Filed: Jul. 1, 1993

[51] Int. Cl.[6] ..... G03G 5/047

[52] U.S. Cl. ..... 430/130; 430/132; 430/136; 430/97

[58] Field of Search ..... 430/58, 59, 97, 130, 430/132, 136

[56] References Cited

U.S. PATENT DOCUMENTS

| | | | |
|---|---|---|---|
| 3,434,832 | 3/1969 | Joseph et al. | 430/66 |
| 3,861,915 | 1/1975 | Cawley . | |
| 4,052,205 | 10/1977 | Stolka et al. | 430/58 |
| 4,115,116 | 9/1978 | Stolka et al. | 430/59 |
| 4,150,987 | 4/1979 | Anderson et al. | 430/59 |
| 4,251,612 | 2/1981 | Chu et al. | 430/58 |
| 4,282,298 | 8/1981 | Smith et al. | 430/58 |
| 4,371,600 | 2/1983 | Schank et al. | 430/66 |
| 4,423,129 | 12/1983 | Takasu et al. | 430/59 |
| 4,518,669 | 5/1985 | Yashiki | 430/57 |
| 4,565,760 | 1/1986 | Schank | 430/66 |
| 4,632,892 | 12/1986 | Yashiki et al. | 430/58 |
| 4,727,009 | 2/1988 | Takai | 430/59 X |
| 4,894,304 | 1/1990 | Ueda | 430/58 |

FOREIGN PATENT DOCUMENTS

| | | | |
|---|---|---|---|
| 69638 | 6/1981 | Japan | 430/130 |
| 204087 | 8/1989 | Japan | 430/130 |
| 161757 | 7/1991 | Japan | 430/130 |

*Primary Examiner*—Roland Martin
*Attorney, Agent, or Firm*—Harris Beach & Wilcox

[57] ABSTRACT

A method of restoring a used organic photoreceptor which includes a supporting substrate having a photoconductor layer contained on said substrate and an overlaying layer of charge transport material. The photoreceptor is heated to a temperature near or above the glass transition temperature of the charge transport layer for a time sufficient to allow for flowing and/or melting of the top surface of the charge transport layer, and then cooled to room temperature, followed by applying a new layer of charge transport material over the existing charge transport layer.

10 Claims, 1 Drawing Sheet

REJUVENATED ORGANIC PHOTORECEPTOR AND METHOD

FIELD OF THE INVENTION

This invention relates to a method of rejuvenating an electrophotographic photoreceptor and more particularly an electrophotographic photoreceptor which has been fabricated from an existing organic photoreceptor by rejuvenating the original coatings and adding an additional new charge transport layer.

BACKGROUND OF THE INVENTION

Many different types of materials have been utilized as electrophotographic photoreceptors in electrophotography. Examples of typical photoreceptors include (1) amorphous selenium, selenium-tellurium alloys or selenium-arsenic alloys; (2) inorganic photoconductive materials such as ZnO and CdS dispersed in a resin binder; (3) suitable organic materials such as azos, phthalocyanines, hydrazones, PVK, etc., usually in a binder resin; and (4) composite structures in the form of two or more layers of the above mentioned photoconductive materials.

All of the above described photoreceptors suffer wear and surface damage during the electrical and mechanical operations of electrophotographic process, and in particular during the steps of the process known as charging, exposure, development, transfer and cleaning. As a result of these problems there have been many prior art proposals for eliminating or minimizing this wear and or damage that takes place during the use of the photoreceptor.

U.S. Pat. No. 4,251,612, for example, describes an overcoated layered imaging member having a substrate, a hole injecting layer overcoated with a hole transport layer, and a photogenerating layer, and an insulating organic resin top coating. Devices of this type have been found to be very useful in various imaging systems, and have the advantage of providing high quality images, with the overcoating acting primarily as a protective top layer.

U.S. Pat. No. 3,861,915 describes solvent soluble block copolyesters of polysiloxanes of the type as illustrated in the patent. It is indicated that such copolymers have excellent leveling and release properties, and produce photoreceptors with improved surface characteristics, including the prevention of excessive wear.

There is also disclosed in U.S. Pat. No. 4,37 1,600, photoresponsive members with overcoatings comprised of certain crosslinked siloxy coupled dihydroxy compounds, such as bisphenol-A copolymers. These materials provide for rapid release of toner particles from the photoresponsive member to a permanent substrate such as paper.

U.S. Pat. No. 3,434,832 describes a photoconductive member with a protective coating of a film forming resin and at least one metallic stearate; and U.S. Pat. No. 4,565,760 discloses a photoreceptor with a release protective coating consisting of a dispersion of colloidal silica and a hydroxylated silsesquixone in an alcoholic medium; and U.S. Pat. No. 4,894,304 discloses a photoreceptor with a transparent protective resin overcoat, wherein this layer contains magnesium fluoride of 1 μm or less in maximum particle size and 0.1 μm or less in mean particle size dispersed in resin at the content of 5–60% by weight of resin.

Although the photoreceptors described in these earlier patents were successful for certain applications, the majority of photoreceptors in commercial use, and particularly the organic photoreceptors, have a relatively short life. It can be seen that the current state of the art has not provided a satisfactory solution to the problems of photoreceptor wear and damage, and that these photoreceptors need to be replaced on a regular basis.

It is therefore an object of the present invention to provide a process for taking an organic photoreceptor that has reached the end of its useful life or is deemed to be near the end of its life and to transform it in such a manner as to significantly extend its useful life.

Another object of the present invention is to provide a process for rejuvenating the coatings of used organic photoreceptors in such a manner that they are functionally similar to the coatings on a new organic photoreceptor.

It is yet another object of the present invention to provide a process for applying a new charge transfer top layer to a used organic photoreceptor to replace the material that has been worn away with use.

SUMMARY OF THE INVENTION

The above objects and other features of the present invention are accomplished by taking a used organic photoreceptor, typically in the form of a layered organic photoreceptor contained on an aluminum drum substrate. The photoreceptor comprises an organic charge generating photoconductive layer on the aluminium substrate and an organic hole charge transport layer overlaying the photoconductive layer. The invention comprises thoroughly cleaning the surface of the photoreceptor, and rejuvenating the photoreceptor by heating it to a temperature near or above the glass transition temperature of the binder material contained in the charge transport layer, followed by providing a coating of new charge transfer layer on the top surface of the photoreceptor. Alternatively, the coating of new charge transport material may be applied prior to the heating step.

The used organic photoreceptor may be in any form such as a drum type from a copier, copier cartridge, printer or printer cartridge. The cleaning step should remove any residual toner from the photoreceptor as well as remove any excess surface oxidation and other corona products from the surface of the photoreceptor.

After cleaning, the drum is heated to a temperature that is higher than the glass transition temperature of the binder material contained in the charge transport coating that forms the top layer of the drum. The drum is maintained at this temperature for a period of time sufficient to soften the coating and allow it to flow. The drum is then cooled to a temperature substantially below the glass transition temperature or to a temperature where the coating is not tacky. Typically, this cooling rate is less than 1.5° C. per minute.

The heating of the drum accomplishes two things. First, by bringing the temperature near or above the glass transition temperature, there tends to be a certain amount of flowing in the top surface of the charge transport coating. This flow removes small scratches that have occurred in the surface during the earlier use of the drum. Also during use, the material used as the binder resin in the top layer of charge transport material loses its original amorphous character, and has a tendency to become crystalline. This is particularly evident when the binder material is an acrylic or styrene-acrylic. The heating of the drum near or above the glass transition temperature of the binder material contained in the charge transport layer, and allowing the layer to cool slowly, restores the surface of the charge transport layer to its original amorphous state. For example, testing a used Canon SX drum in a Hewlett-Packard LaserJet Series II printer produces prints made after heat treating according to the present invention that have either a higher and/or more uniform print density than those made on the same used drum prior to heat treating. Therefore, in the broadest aspect of the invention, the heat treatment alone without a coating of new charge transport material, can also be used to restore or rejuvenate a used organic photoreceptor.

The new charge transport layer can be made from any suitable material which is capable of transporting holes. This layer will generally have a thickness of from about 0.5 to about 10 microns, and preferably from about 1 to 5 microns. Typical materials include hole transport molecules such as hydrazones, oxidiazoles, triphenylmethanes, diamines, pyrazolines, triazoles, stilbenes, etc.

This active hole transport material is typically dispersed in an electrically inactive binder material such as polycarbonates, polyester resins, epoxy resins, polyurethanes, acrylic resins, alkyd resins, polysulfone, methacrylate resins, styrene resins, alkyd resins, vinyl chloride resins, vinyl acetate resin, phenolic resins, or copolymers containing two or more repeating units of these resins. The amount of binder material is typically in the range from 20 to 80 percent (by weight) and preferably from about 40 to 70 percent.

Other suitable additives may also be included in the charge transport layer. For example, release materials such as metallic stearates and polyvinylidene fluoride; deoxidizers such as butylated hydroxytoluene; and surface active agents such as silicone oils.

Any suitable method of coating, such as dip, applicator or spray may be used to apply the new charge transport layer.

DETAILED DESCRIPTION OF THE INVENTION

Figure 1:
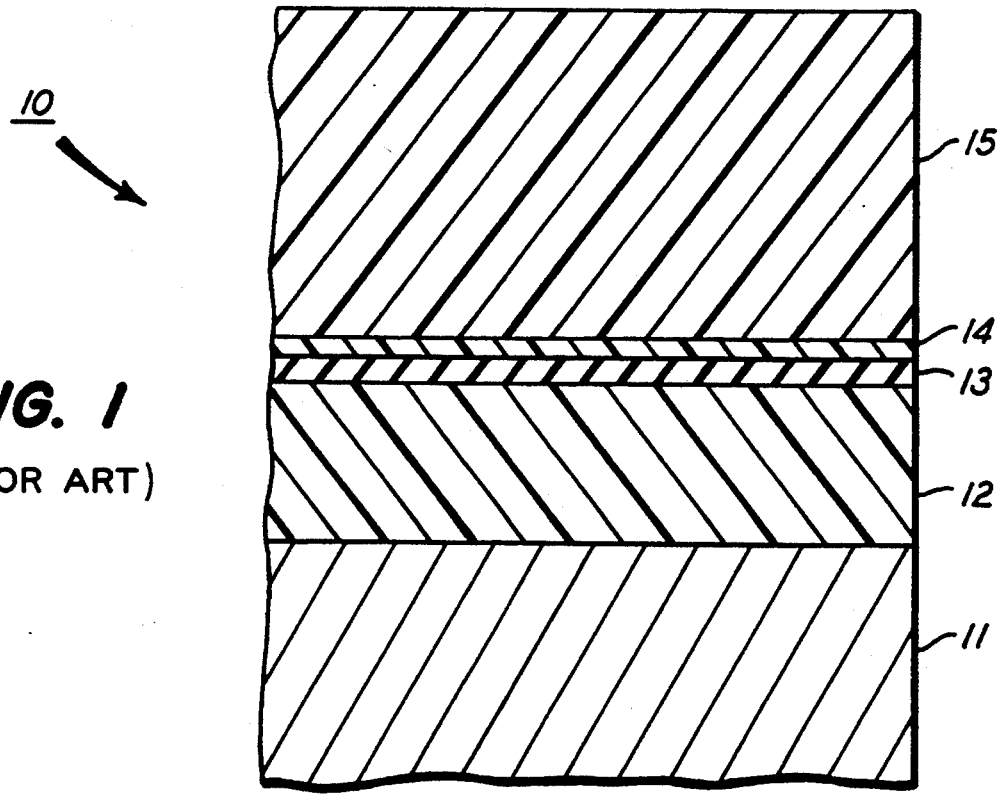
FIG. 1 (PRIOR ART)
FIG. 1 illustrates the cross section of a typical prior art organic photoreceptor.

FIG. 1 illustrates the cross-section of one embodiment of a typical prior art organic photoreceptor drum 10 which may be treated by the present invention. The drum has a multilayer structure comprising an electroconductive substrate 11, an intermediate layer 12, an adhesion and/or charge blocking layer 13, a charge generating layer 14, and a charge transporting layer 15. The intermediate layer 12 is optional, and in many drums this layer is omitted. U.S. Pat. No. 4,518,669 teaches a typical intermediate layer used in the art and is incorporated herein by reference. U.S. Pat. No. 4,150,987 and 4,423,129 both teach organic photoreceptors which are of the type suitable for treatment by the present invention and are also incorporated herein by the reference.

Figure 2:
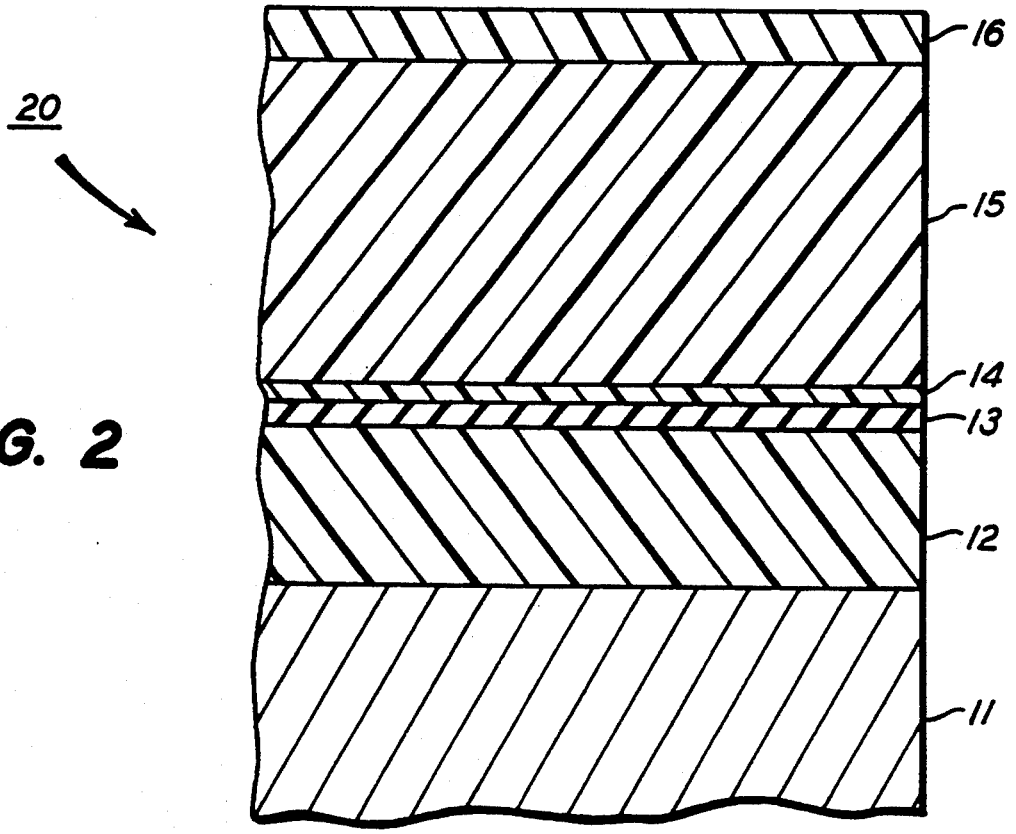
FIG. 2 illustrates the cross-section of a typical prior art organic photoreceptor after treatment according to the present invention.

FIG. 2 illustrates the cross-section of an organic photoreceptor drum 20 which has been rejuvenated according to one embodiment of the present invention. Layers 11 through 15 are the same as in FIG. 1. Layer 16 is an additional charge transport layer and consists of a charge transport material which is capable of transporting holes, a binder polymer and possible other additives such as release materials, deoxidizers and surface active agents.

The following examples illustrate various embodiments of the present invention.

Example 1

A used Canon SX type drum photoreceptor which has been removed from its cartridge is thoroughly cleaned using isopropyl alcohol. The operative structure of the drum comprises an aluminum conductive substrate, an organic charge generating photoconductive layer on said substrate and an organic hole charge transport layer overlaying the photoconductive layer. The drum is placed in an oven which is already at a temperature of about 115° C. and held at this temperature for a period of 30 minutes. The oven is then turned off and allowed to cool for one hour before removing the drum. The oven temperature at this point is typically about 65° C. to 75° C. The drum is then coated on an Anakenesis Photoreceptor Auto Lathe which rotates at about 200 to 250 RPM. The coating is applied using a Chemtronics Foamtip #120 which has been saturated with a solution containing the following composition in percentages by weight:

| | |
|---|---|
| Elvacite 2045 | 7.0% |
| DEH | 3.0% |
| Toluene | 20.0% |
| IPA | 52.5% |
| 1-Butanol | 17.5% |

The foamtip applicator traverses the lathe for approximately one minute. The coating method results in a final cured thickness of about 1–3 microns. The coating is then cured for approximately two and a half minutes using infrared heat lamps. Note: Elvacite 2045 is an acrylic resin manufactured by the DuPont Company, Wilmington, Del. IPA is isopropyl alcohol. DEH is 4-diethylamino-benzaldehyde-N, N-diphenylhydrazone manufactured by Mackenzie Chemical Works, Bush, La.

Example 2

Another used Canon SX drum is cleaned, heat treated and coated as in Example 1, using the following coating solution:

| | |
|---|---|
| Elvacite 2045 | 5.0% |
| Acryloid B67 | 5.0% |
| DEH | 4.9% |
| Toluene | 19.7% |
| IPA | 48.2% |
| 1-Butanol | 16.1% |
| BHT | 0.1% |
| Kynar 301F | 1.0% |

Note: BHT is butylated hydroxytoluene and is manufactured by UOP, Des Plaines, Illinois. Kynar 301F is a polyvinylidene fluoride manufactured by the Pennwalt Corporation, Philadelphia, PA.

Example 3

Another used Canon SX drum is cleaned, heat treated and coated as in Example 1, using the following coating solution:

| | |
|---|---|
| Elvacite 2045 | 5.0% |
| DEH | 5.0% |
| IPA | 70.0% |
| Toluene | 20.0% |

Example 4

Another used Canon SX drum is cleaned using isopropyl alcohol and coated as in Example 1, using the following coating solution:

| | |
|---|---|
| Elvacite 2045 | 5.0% |
| DEH | 5.0% |
| Toluene | 20.0% |
| IPA | 52.4% |
| 1-Butanol | 17.5% |
| BHT | 0.1% |

After coating, the drum is placed in an oven which has been brought up to a temperature of 110° C. and held at this temperature for a period of 30 minutes. The oven is then allowed to cool for a period of two hours (to room temperature) before the drum is removed.

Example 5

A used Canon SL photoreceptor drum is cleaned, heat treated and coated as in Example 1. The coating solution used for this drum has the following percentages by weight:

| | |
|---|---|
| Elvacite 2045 | 5.0% |
| DEH | 5.0% |
| Toluene | 20.0% |
| IPA | 63.0% |
| 1-Butanol | 7.0% |

Example 6

A used Canon SX type drum is cleaned and heat treated an in Example 1. The drum is then placed in a fixture which rotates the drum at approximately 200 to 250 rpm. Using a Binks spray gun model Mach 1 HVLP, the drum is spray coated with the following solution:

| | |
|---|---|
| Elvacite 2045 | 5.0% |
| DEH | 5.0% |
| Toluene | 20.0% |
| IPA | 65.0% |
| Xylene | 5.0% |

Example 7

Another used Canon SX drum is cleaned, heat treated and spray coated as in Example 6, using the following coating solution:

| | |
|---|---|
| Piccotoner 1218 | 5.0% |
| DEH | 5.0% |
| Toluene | 90.0% |

Note: Piccotoner 1218 is a styrene-acrylic copolymer manufactured by Hercules, Inc., Wilmington, DE.

Example 8

A used Canon SX drum is cleaned, heat treated and coated as in Example 1, using the following coating solution:

| | |
|---|---|
| Elvacite 2043 | 6.0% |
| DEH | 4.0% |
| Toluene | 16.0% |
| Ethyl alcohol | 24.0% |
| IPA | 50.0% |

Note: Elvacite 2043 is an acrylic resin manufactured by DuPont.

Example 9

Yet another used Canon dram is cleaned, heat treated and coated as in Example 1, using the following coating solution:

| | |
|---|---|
| Acryloid B67 | 3.0% |
| Elvacite 2043 | 3.0% |
| T-191 | 2.0% |
| T-405 | 2.0% |
| Toluene | 16.0% |
| Ethyl alcohol | 12.0% |
| IPA | 62.0% |

Note: Acryloid B67 is an acrylic resin Manufactured by Rohm & Haas Company, Philadelphia, PA. T-191 is a hydrazone compound manufactured by Takasago International Corporation, Tokyo, Japan. T-405 is a butadiene derivative also manufactured by Takasago.

Example 10

A used Canon SX drum is cleaned and heat treated as in Example 1. In this instance no new charge transport layer is coated over the original charge transport layer. The heat treatment process alone results in a significant improvement in the performance properties of the drum.

The drums of Examples 1–10 are tested in the following manner: Prints are generated before and after the rejuventation process using both a 5% coverage text pattern and a solid black pattern. All Canon SX drums for a given example were tested in the same cartridge on a Hewlett Packard Laser Jet III printer. For the Canon SL photoreceptor drum (Example 5), test prints were generated on a Hewlett Packard IIP printer.

In most cases, the coating thickness of the OPC drum was measured before and after the rejuvenation process using a Fischer Isoscope MP coating thickness measurement device.

In all cases, prints are also visually examined before and after the rejuvenation process.

Test results for Examples 1–10 are summarized in Table I.

TABLE I

OPC DATA BEFORE/AFTER REJUVENATTON

| Example | Density (Before) | Density (After) | Average Coating Thickness(μ) |
|---|---|---|---|
| 1 | 1.18 | 1.43 | 1.9 |
| 2 | 1.25 | 1.31 | 3.1 |
| 3 | 1.29 | 1.43 | 0.8 |
| 4 | 1.28 | 1.32 | — |
| 5 | 1.37 | 1.45 | 1.7 |
| 6 | 1.21 | 1.31 | 0.9 |
| 7 | 1.32 | 1.42 | 0.4 |
| 8 | 1.30 | 1.40 | — |
| 9 | 1.31 | 1.37 | — |

TABLE I-continued

| OPC DATA BEFORE/AFTER REJUVENATTON | | | |
|---|---|---|---|
| Example | Density (Before) | Density (After) | Average Coating Thickness(μ) |
| 10 | 1.29 | 1.38 | N/A |

Observations: In each case, significant density improvement was observed and improved density uniformity resulted.

Coating Procedure: As described in examples.

Heating Procedure: As described in examples.

While the invention has been described in detail with respect to specific embodiments thereof, it will be understood by those skilled in the art that variations and modifications may be made without departing from the essential features thereof.

What is claimed:

1. A method of restoring a used photoreceptor which comprises a supporting substrate, an organic photoconductor layer contained on said substrate, and a charge transport layer overlaying said organic photoconductor layer, said method comprising:

(a) heating said photoreceptor to a temperature near or above the glass transition temperature of the charge transport layer for a time sufficient to allow for flowing and/or melting of the top surface of said charge transport layer;

(b) cooling said photoreceptor down to room temperature; and coating a layer of charge transport material on the outer surface of the photoreceptor.

2. The method of claim 1 in which the thickness of the charge transport layer is from about 0.5 to 15 microns.

3. The method of claim 2 in which the charge transport layer contains at least one material capable of hole transport selected from the group consisting of hydrazones, oxidiazoles, triphenylmethanes, diamines, pyrazolines, triazoles, and stilbenes.

4. The method of claim 3 in which the hole transport material is dispersed in an inactive binder material.

5. A method of restoring a used photoreceptor which comprises a supporting substrate, an organic photoconductor layer contained on said substrate, and a charge transport layer overlaying said organic photoconductor layer, said method comprising:

(a) forming a layer of charge transport material over the existing charge transport layer;

(b) heating said photoreceptor to a temperature near or above the glass transition temperature of the charge transport material for a time sufficient to allow for flowing and/or melting of the top surface of said charge transport material; and (c) cooling said photoreceptor down to room temperature

6. The method of claim 5 comprising cooling the photoreceptor to room temperature at a rate of less than 1.5° C. per minute.

7. The method of claim 5 in which the heat treatment is carried out at temperature(s) in the range of about 80° to 140° C. for a time in the range of about 20 to 120 minutes.

8. The method of claim 5 in which the heat treatment is carried out at temperature(s) in the range of about 80° to 140° C. for a time in the range of about 20 to 120 minutes.

9. The method of claim 5 in which the charge transport layer contains at least one material capable of hole transport selected from the group consisting of hydrazones, oxidiazoles, triphenylmethanes, diamines, pyrazolines, triazoles, and stilbenes.

10. The method of claim 9 in which the hole transport material is dispersed in an inactive binder material.

* * * * *